US010722027B2

(12) United States Patent
Pintar et al.

(10) Patent No.: US 10,722,027 B2
(45) Date of Patent: Jul. 28, 2020

(54) TIMER-BASED ELECTRONIC WEAPON SECURITY APPARATUS

(71) Applicant: Blac-Rac Manufacturing, Inc., Boise, ID (US)

(72) Inventors: Kevin B. Pintar, Meridian, ID (US); Thomas Torres, Meridian, ID (US); Cory Ytsma, Boise, ID (US)

(73) Assignee: BLAC-RAC MANUFACTURING, INC., Boise, ID (US)

( * ) Notice: Subject to any disclaimer, the term of this patent is extended or adjusted under 35 U.S.C. 154(b) by 0 days.

(21) Appl. No.: 15/716,122

(22) Filed: Sep. 26, 2017

(65) Prior Publication Data

US 2019/0093969 A1 Mar. 28, 2019

(51) Int. Cl.

| | |
|---|---|
| ***A47B 81/00*** | (2006.01) |
| ***F41A 17/02*** | (2006.01) |
| ***A47F 3/00*** | (2006.01) |

(52) U.S. Cl.

CPC ..... *A47B 81/005* (2013.01); *A47F 3/002* (2013.01); *F41A 17/02* (2013.01)

(58) Field of Classification Search

CPC ..... A47B 81/00; A47B 81/005; A47B 81/007; B60R 7/14; F41A 17/00–17/06; F41A 23/18; Y10S 224/911–224/913; F41C 33/06

USPC ..... 42/70.11; 206/317; 211/64

See application file for complete search history.

(56) References Cited

U.S. PATENT DOCUMENTS

| | | | | |
|---|---|---|---|---|
| 2,668,645 | A * | 2/1954 | Pease | B60R 7/14 224/546 |
| 3,802,612 | A * | 4/1974 | Smith | B60R 7/14 224/569 |
| 4,747,280 | A * | 5/1988 | Shaw | E05B 47/0002 211/64 |
| 4,949,559 | A * | 8/1990 | Glines | B60R 7/14 211/64 |
| 5,012,606 | A * | 5/1991 | McNulty, Jr. | A47B 81/005 361/194 |
| 5,350,094 | A * | 9/1994 | Morford | B60R 7/14 211/64 |
| 5,438,787 | A * | 8/1995 | McMaster | A47B 81/005 211/64 |
| 6,584,719 | B1 * | 7/2003 | Morford | B60R 7/14 224/551 |
| 7,047,771 | B2 * | 5/2006 | Tanos | E05B 15/0046 211/64 |

(Continued)

*Primary Examiner* — Stephen Johnson
*Assistant Examiner* — Benjamin S Gomberg
(74) *Attorney, Agent, or Firm* — Parsons Behle & Latimer

(57) ABSTRACT

A weapon security apparatus includes a base member and a gate member pivotably coupled to the base member configured to enclose a portion of a weapon. The apparatus further includes a retractable latch, the retractable latch locking the gate member in the closed position when in a non-retracted state and releasing the gate member when in a retracted state. The apparatus also includes a solenoid configured to retract the retractable latch when activated. The apparatus includes a controller configured to activate the solenoid with a first electrical current for a first period of time during which the retractable latch moves to the retracted position and with a second electrical current for a second period of time during which the retractable latch is held in the retracted position.

17 Claims, 6 Drawing Sheets

(56) References Cited

U.S. PATENT DOCUMENTS

| | | | | |
|---|---|---|---|---|
| 7,658,028 | B2 | 2/2010 | Pintar et al. | |
| 7,826,220 | B1 * | 11/2010 | Baker | F41C 33/06 109/73 |
| 8,266,835 | B2 | 9/2012 | Pintar et al. | |
| 8,826,702 | B1 * | 9/2014 | Barger | E05B 73/00 211/4 |
| 9,151,082 | B2 * | 10/2015 | Zalavari | A47B 81/00 |
| 9,481,312 | B2 * | 11/2016 | Irwin | F41A 23/18 |
| 2017/0276446 | A1 * | 9/2017 | Irwin | F41A 17/06 |

* cited by examiner

TIMER-BASED ELECTRONIC WEAPON SECURITY APPARATUS

FIELD OF THE DISCLOSURE

This disclosure relates generally to weapon security apparatuses and more particularly to timer-based electronic weapon security apparatuses.

BACKGROUND

Typical gun security systems, such as gun racks, prevent the unauthorized access to a weapon by locking key portions of the weapon, thereby neutralizing it while in the security system. Examples of weapon security systems are described with reference to U.S. patent application Ser. No. 15/264,777, filed Sep. 14, 2016 and entitled "Systems and Methods to Prevent Hot-Wiring of Electronic Gun Racks," with reference to U.S. Pat. No. 8,266,835 filed on Jan. 6, 2010 and entitled "Firearm Security Device," and with reference to U.S. Pat. No. 7,658,028 filed on Jan. 30, 2008 and entitled "Firearm Security Device," the contents of each of which are hereby incorporated by reference in their entirety.

Typical electronic weapon security devices may be unlocked applying an electrical current to a solenoid, which in turn applies a force to a latch, causing the latch to retract. The latch may then be held in a retracted state for a predetermined duration. Electrical current may be passed through the solenoid for the entire duration, potentially resulting in a significant power usage. This significant power usage may be problematic if the electronic weapon security device is coupled to a portable power source, such as a battery. It may also cause the solenoid to wear out prematurely. Another drawback of typical weapon security devices is that they may employ locking pins at a hinge side of an openable gate. This locking pin placement may result in weakness at the gate when it is closed. Other disadvantages may exist.

SUMMARY

The present disclosure addresses at least some of the potential disadvantages of typical weapon security apparatuses. For example, a weapon security apparatus may control electric power, current, and/or voltage variability in contrast to typical weapon security devices. For example, the weapon security apparatus may apply an initial electrical current to a solenoid that is sufficient to retract a retractable latch and then apply a smaller electrical current to hold the retractable latch in place. The weapon security apparatus may include a gate member that locks on a distal end opposite its hinge. The weapon security apparatus may further be manufactured from strong materials including metals and metal alloys. In order to provide additional strength, the apparatus may be formed from a billet metal or alloy.

In an embodiment, a weapon security apparatus includes a base member and a gate member pivotably coupled to the base member, the gate member moveable between an open position and a closed position relative to the base member, the base member and the gate member configured to enclose a portion of a weapon when the gate member is in the closed position. The apparatus further includes a retractable latch, the retractable latch locking the gate member in the closed position when in a non-retracted state and releasing the gate member when in a retracted state. The apparatus also includes a solenoid configured to retract the retractable latch when activated. The apparatus includes a controller configured to activate the solenoid with a first electrical current for a first period of time during which the retractable latch moves to the retracted position and with a second electrical current for a second period of time during which the retractable latch is held in the retracted position.

In some embodiments, the gate member has a proximal end and a distal end, the proximal end pivotably attached to the base member, a surface at the distal end having a bore configured to receive the retractable latch therein when the retractable latch is in the non-retracted state. In some embodiments, the apparatus includes a locking pin moveable between a locked position and an unlocked position, the locking pin locking the gate in the closed position when in the locked position and releasing the gate when in the unlocked position. In some embodiments, the retractable latch is configured to lock the gate member at a first point, and where the locking pin is configured to lock the gate member at a second point. In some embodiments, the first point and the second point are positioned on perpendicular surfaces. In some embodiments, the apparatus includes a key lock to enable a user to move the locking pin between the locked position and the unlocked position using a key. In some embodiments, the first electrical current is greater than the second electrical current. In some embodiments, the second electrical current is sufficient to hold the retractable latch in the retracted position but not sufficient to retract the retractable latch. In some embodiments, the apparatus includes a biasing member configured to move the retractable latch into the non-retracted position when the solenoid is not activated. In some embodiments, the biasing member is a spring. In some embodiments, the base member and the gate member are formed from a billet metal material. In some embodiments, the controller is integrated into the base member. In some embodiments, the apparatus includes an auxiliary power source. In some embodiments, the apparatus includes a grip pad component configured to protect the weapon while the weapon is retained by the apparatus.

In an embodiment, a weapon security apparatus includes a base member and a gate member pivotably coupled to the base member, the gate member moveable between an open position and a closed position relative to the base member, the base member and the gate member configured to enclose a portion of a weapon when the gate member is in the closed position. The apparatus further includes a retractable latch, the retractable latch locking the gate member in the closed position when in a non-retracted state and releasing the gate member when in a retracted state, wherein the gate member has a proximal end and a distal end, the proximal end pivotably attached to the base member, the distal end having a bore configured to receive the retractable latch therein when the retractable latch is in the non-retracted state.

In some embodiments, the apparatus includes a solenoid configured to retract the retractable latch when activated, and a controller configured to activate the solenoid with a first electrical current for a first period of time during which the retractable latch moves to the retracted position and with a second electrical current for a second period of time during which the retractable latch is held in the retracted position. In some embodiments, the first electrical current is higher than the second electrical current. In some embodiments, the second electrical current is sufficient to hold the retractable latch in the retracted position but not sufficient to retract the retractable latch. In some embodiments, the apparatus includes a biasing member configured to move the retractable latch into the non-retracted position when the solenoid is not activated. In some embodiments, the apparatus includes a locking pin moveable between a locked position and an unlocked position, the locking pin locking the gate member in the closed position when in the locked position and releasing the gate member when in the unlocked position. In some embodiments, the retractable latch is configured to lock the gate member at a first point, and wherein the locking pin is configured to lock the gate member at a second point.

In an embodiment, a method includes providing a base member of for a weapon security apparatus. The method further includes providing a gate member pivotably coupled to the base, the gate member moveable between an open position and a closed position relative to the base member, the base member and the gate member configured to enclose a portion of a weapon when the gate member is in the closed position. The method also includes providing a retractable latch, the retractable latch locking the gate member in the closed position when in a non-retracted state and releasing the gate member when in a retracted state. The method includes providing a solenoid configured to retract the retractable latch when activated. The method further includes providing a controller configured to activate the solenoid with a first electrical current for a first period of time during which the retractable latch moves to the retracted position and with a second electrical current for a second period of time during which the retractable latch is held in the retracted position.

In some embodiments, the method includes providing a locking pin moveable between a locked position and an unlocked position, the locking pin locking the gate member in the closed position when in a locked position and releasing the gate member when in an unlocked position. In some embodiments, the second electrical current is sufficient to hold the retractable latch in the retracted position but not sufficient to retract the retractable latch.

Figure 1:
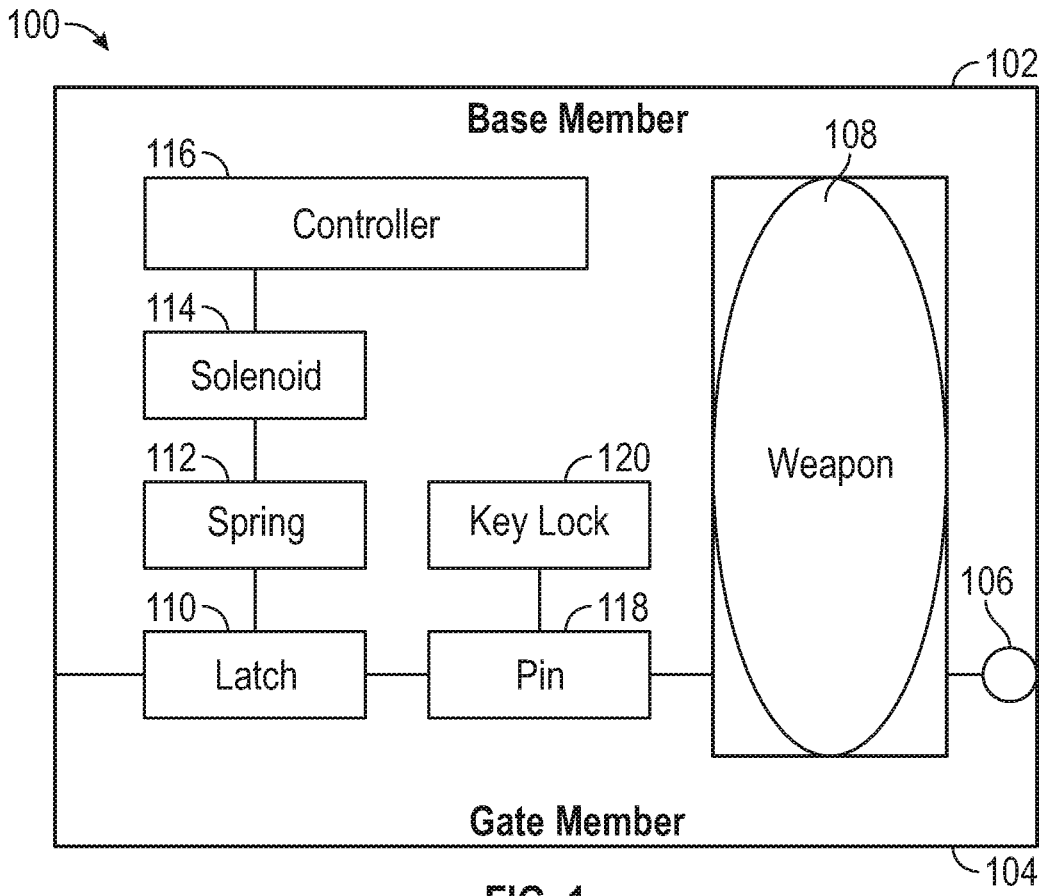
FIG. 1 is a block diagram depicting an embodiment of a weapon security apparatus.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the disclosure as defined by the appended claims.

DETAILED DESCRIPTION

Referring to FIG. 1, a block diagram of an embodiment of a weapon security apparatus 100 is depicted. The apparatus may include a base member 102 and a gate member 104. Together, the base member 102 and the gate member 104 may form a "clam shell" appearance and may be used to secure a weapon (e.g., a rifle, a shotgun, etc.) therebetween. The apparatus 100 may be compatible with the hot-wire prevention capabilities described with reference to U.S. patent application Ser. No. 15/264,777, filed Sep. 14, 2016 and entitled "Systems and Methods to Prevent Hot-Wiring of Electronic Gun Racks," referenced herein. Likewise, the apparatus 100 may be compatible with the unlocking signal capabilities described with reference to U.S. Pat. No. 8,266,835 filed on Jan. 6, 2010 and entitled "Firearm Security Device."

Figure 3:
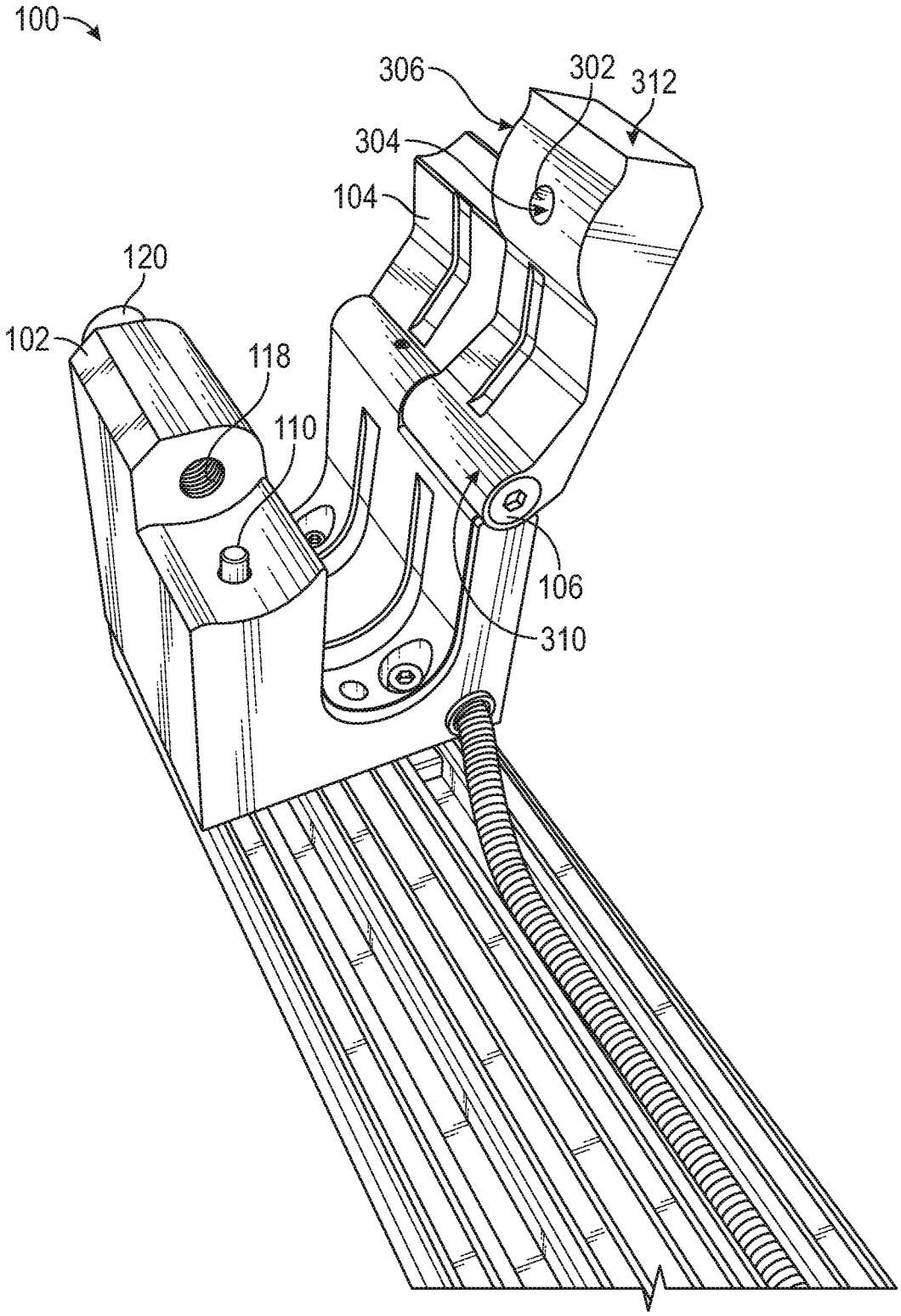
FIG. 3 depicts an embodiment of a weapon security apparatus.
Figure 4:
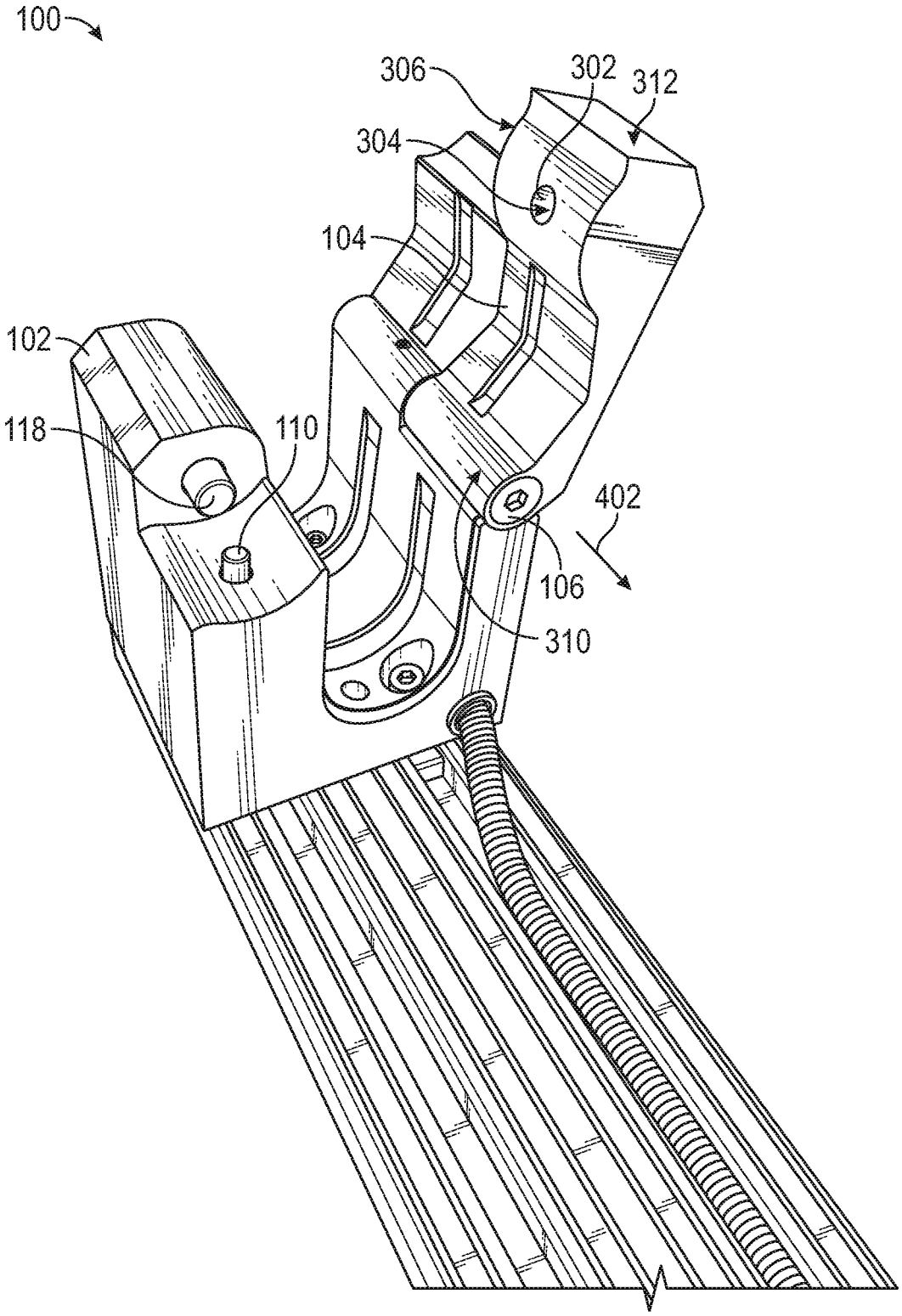
FIG. 4 depicts an embodiment of a weapon security apparatus with a locking pin in a locked position.
Figure 5:
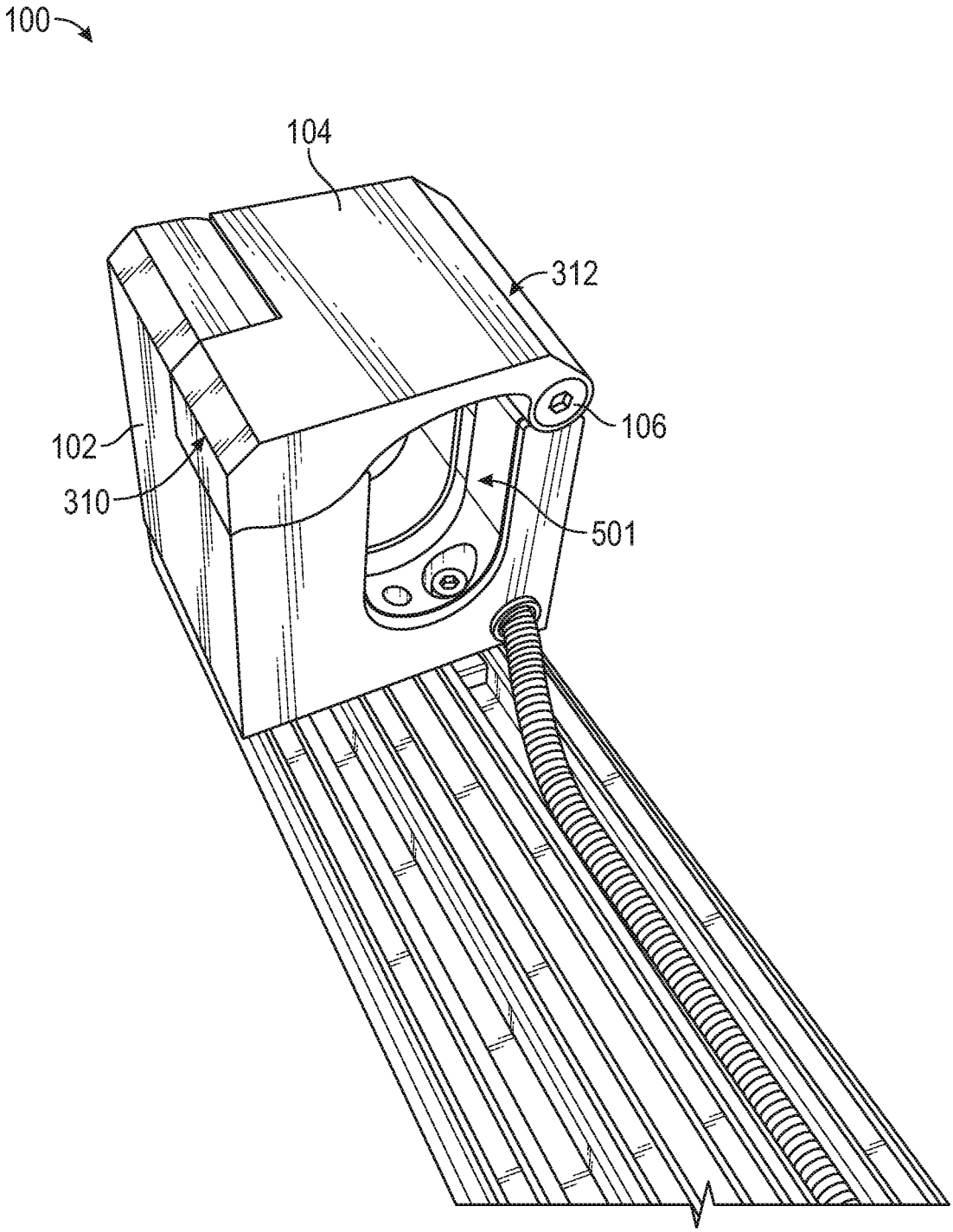
FIG. 5 depicts an embodiment of a weapon security apparatus with a gate member in a closed position.

The gate member 104 may be pivotably attached to the base member 102 at a hinge 106. As such, the gate member 104 may pivot between a closed position, as depicted in FIGS. 1 and 5, and an open position, as depicted in FIGS. 3 and 4. When in the closed position, the base member 102 and the gate member 104 may at least partially enclose a portion of a weapon 108. The weapon 108 may be a shotgun, rifle, or some other type of firearm. Further, the weapon 108 may be enclosed by the apparatus 100 around a barrel, stock, trigger guard, another element of the weapon 108, or combinations thereof.

A grip pad component 107 may be positioned along a surface of the base member 102 to secure the weapon 108 in place. The grip pad component 107 may include a synthetic thermal rubber that absorbs vibration and shock to prevent damage to the weapon 108. An advantage of the grip pad component 107 is that a weapon may be protected in addition to being retained, in contrast to typical weapon retention apparatuses that only retain a weapon without additional protection. Other advantages may exist.

Within the base member 102, the apparatus may include a retractable latch 110, a spring 112, and a solenoid 114. The retractable latch 110 may be moveable between a retracted position and an unretracted position. When in the unretracted position, the retractable latch 110 may engage a portion of the gate member 104, thereby locking it in place and preventing removal of the weapon 108 from the apparatus 100.

The weapon security apparatus 100 may include a member that biases the retractable latch 110 towards the unretracted position. For example, the spring 112 may be configured to apply a force to the retractable latch 110, pushing the retractable latch 110 into the unretracted position. As such, upon closing, the gate member 104 may lock automatically.

The solenoid 114, when activated, may apply a force to the retractable latch 110 that opposes the force applied by the spring 112. As described herein, the solenoid 114 may be configured to apply a first force during a first period of time, the first force sufficient to retract the retractable latch 110. The solenoid 114 may be configured to apply a second force during a second period of time, the second force sufficient to hold the retractable latch 110 in the retracted position. In some embodiments, the force applied by the solenoid 114 may be sufficient to balance the force of the spring 112, thereby holding the retractable latch 110 in the retracted position, but may not be sufficient to pull the retractable latch 110 from the unretracted position into the retracted position. In that way, electrical power may be conserved within the apparatus 100.

A controller 116 may control the force applied by the solenoid 114 to the retractable latch 110. Upon actuation, the controller 116 may be configured to apply a first current to the solenoid 114 for a first period of time and a second electrical current to the solenoid 114 for a second period of time, as described herein. In some embodiments, the controller 116 is integrated into the base member 102. An advantage of integrating the controller 116 into the base member 102 is that the controller may be more secure, in contrast to typical weapon retention apparatuses that may have external controllers.

The controller 116 may include logic circuitry, timing circuitry, and other types of circuitry to perform the operations described herein. In some embodiments, the controller 116 may include a central processing unit (CPU), a graphical processing unit (GPU), a digital signal processor (DSP), a peripheral interface controller (PIC), or another type of microprocessor. It may be implemented as an integrated circuit, a field programmable gate array (FPGA), an application specific integrated circuit (ASIC), a combination of logic gate circuitry, other types of digital or analog electrical design components, or combinations thereof. A memory (not shown) may be coupled with, or included as part of, the controller 116. The memory may store instructions that cause the controller to perform the operations described herein.

The apparatus 100 may include an auxiliary power supply. The auxiliary power supply may be internal to the base member 102, or external. During operation, the auxiliary power supply may charge while the controller 116 is coupled to an external power source. Then, in cases where access to external power is limited (e.g., a vehicle power source has died, a power cable is severed, etc.) the external power source may provide power to the controller and the solenoid. The auxiliary power source may store enough electrical energy to enable the apparatus to open and close multiple times.

The apparatus 100 may further include a locking pin 118 and a key lock 120. The locking pin 118 may be moveable between a locked position and an unlocked position. When in the locked position, the locking pin 118 may engage a portion of the gate member 104 to lock the gate member 104 in the closed position. The key lock 120 may enable a user to move the locking pin 118 with a key.

A benefit of the apparatus 100 is that by applying an initial electrical current to the solenoid that is sufficient to retract the retractable latch 110, and then applying a smaller current to hold the retractable latch 110 in place, the apparatus 100 may conserve power as compared to typical weapon security apparatuses that apply a single strong current for the duration of an unlock period. Other benefits may exist.

Figure 2:
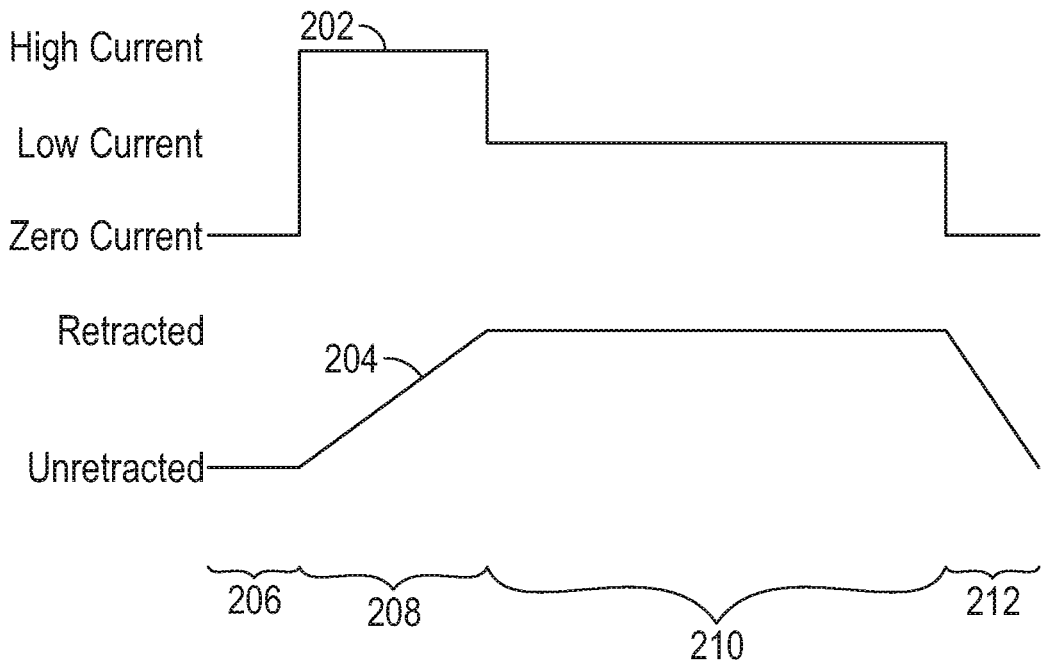
FIG. 2 is a timing diagram depicted an electrical current applied to a solenoid of a weapon security apparatus and a position of a retractable latch of the weapon security apparatus.

Referring to FIG. 2, a timing diagram for a current 202 supplied to the solenoid 114 and a position 204 of the retractable latch 110 are depicted. During an initial period 206, the electrical current 202 is approximately zero. For example, the controller 116 may supply no current to the solenoid 114 such that the spring 112 pushes and holds the retractable latch 110 into the unretracted position, thereby locking the gate member 104.

During a retraction period 208, the current 202 supplied to the solenoid 114 is raised to a high current. As used herein, a high current means a current that is sufficient to cause the retractable latch 110 to retract against the force of the spring 112. The duration of the retraction period 208 may be predetermined, or the duration may be determined based on the position 204 of the retractable latch 110. For example, the controller 116 may be configured to determine when the retractable latch 110 is fully retracted.

After the retraction period 208, the current 202 may be reduced to a low current during an unlocked period 210. As used herein, a low current means a current that is sufficient to hold a position of the retractable latch 110, but not necessarily sufficient to cause the retractable latch 110 to retract against the force of the spring 112. During the unlocked period 210, the retractable latch 110 may remain in a retracted state, enabling access to the weapon 108. The duration of the unlocked period 210 may be predetermined to give sufficient time to a user to remove the weapon 108. In other embodiments, the controller 116 may be configured to determine when the weapon 108 has been removed based on whether the gate member 104 is opened and subsequently closed. After the unlocked period 208, the current 202 ceases and the position 204 of the retractable latch 110 returns to an unretracted state during a locked period 212.

A benefit of the timing of the current 202 is that by applying an initial electrical current to the solenoid that is sufficient to retract the retractable latch 110, and then applying a smaller current to hold the retractable latch 110 in place, the apparatus 100 may conserve power as compared to typical weapon security apparatuses that apply a single strong current for the duration of an unlock period. Other benefits may exist.

Referring to FIG. 3, an embodiment of a weapon security apparatus 100 is depicted. The weapon security apparatus 100 includes a base member 102, a gate member 104, a hinge 106, a retractable latch 110, a locking pin 118, and a key lock 120, as described herein. In FIG. 3, the apparatus 100 is depicted with the locking pin 118 in the unlocked position.

The gate member 104 may include a bore 302. The bore 302 may be engaged by the retractable latch 110 when the gate member 104 is in the closed position. The bore 302 may be located at a first locking point 304 on the gate member 104. When locked, the gate member 104 may be engaged at the first locking point 304 by the retractable latch 110 and at a second locking point 306 by the locking pin 118. As depicted in FIG. 4, the first locking point 304 and the second locking point 306 may be positioned on perpendicular surfaces. The perpendicular orientation may add strength to the apparatus 100 when locked. Further, in some embodiments, the orientation of the locking points 304, 306 may enable the retractable latch 110 and the locking pin 118 to be used independently. For example, when the locking pin 118 is in the unlocked position as depicted in FIG. 3, in some embodiments, the position of the first locking point 302 may enable the gate 104 to open regardless of the position of the retractable latch 110. Likewise, when the retractable latch 110 is in the retracted position, in some embodiments, the gate member 104 may be able to slide away from the locking pin 118, thereby enabling the gate member 104 to be opened.

By having multiple locking points 302, 304, the apparatus 100 may be more secure as compared to typical weapon security apparatuses. Further, enabling the retractable latch 110 and the locking pin to 118 to be used independently in some embodiments, may add to the convenience of the apparatus 100. For example, in some cases the key lock 120 may be kept in an engaged state while the retractable latch 110 is used solely to secure the gate member 104, such that a user does not have to manually unlock the apparatus 100 with a key each time access to a weapon is desired.

As shown in FIG. 3, the gate member 104 may have a proximal end 310 and a distal end 312. The hinge 106 may rotatably attach the gate member 104 to the base member 102 at the proximal end 310. When the gate member 104 is in the closed position, the retractable latch 110, the locking pin 118, or both, may engage the gate member 104 at the distal end 312. By engaging the gate member 104 at the distal end, the apparatus 100 may be stronger than typical weapon security devices that lock at their hinges. Other advantages may exist.

Referring to FIG. 4, an embodiment of a weapon security apparatus 100 is depicted with a locking pin 118 in the locked position. The weapon security apparatus 100 includes a base member 102, a gate member 104, a hinge 106, a retractable latch 110, a locking pin 118, and a key lock, as described herein.

In some embodiments, when the locking pin 118 is in the locked position, the gate member 104 may be unlocked by retracting the retractable latch 110 and by sliding the gate member 104 laterally off of the locking pin 118 as indicated by the arrow 402. Sliding the gate member 104 may enable the gate member 104 to open without moving the locking pin 118 to the unlocked position. Thus, in this embodiment, the gate member 104 may be openable unless both the retractable latch 110 is in the unretracted position and the locking pin 118 is in the locked position. As such, when the locking pin 118 is in the unlocked position, the gate member 102 is always openable and when the locking pin 118 is in the locked position, the gate member 102 is openable when the retractable latch 110 is retracted and the gate member 102 is unopenable when the retractable latch 110 is in the unretracted position.

A benefit of this configuration is that a user can maintain the locking pin 118 in the locked position during use and rely solely on the electronically controlled retractable latch 110 to secure a weapon. Then, in cases that may arise where power cannot be supplied to the apparatus 100, the manual key lock 120 may be used to remove the weapon.

Referring to FIG. 5, an embodiment of a weapon security apparatus 100 is depicted with a gate member in a closed position. The weapon security apparatus 100 includes a base member 102, a gate member 104, and a hinge 106, as described herein.

While in the closed position, the gate member 104 may be locked at a distal end 310 while being held at a proximal end 106 by the hinge 106. When in the closed position, the base member 102 and the gate member 104 may form a window 501 in which a weapon may be secured. The base member 102 and the gate member 104 may be made from steel, aluminum, another type of metal, or combinations or alloys thereof. The structure of the apparatus 100 when the gate member 104 is in the closed position may be stronger than typical weapon security devices.

Figure 6:
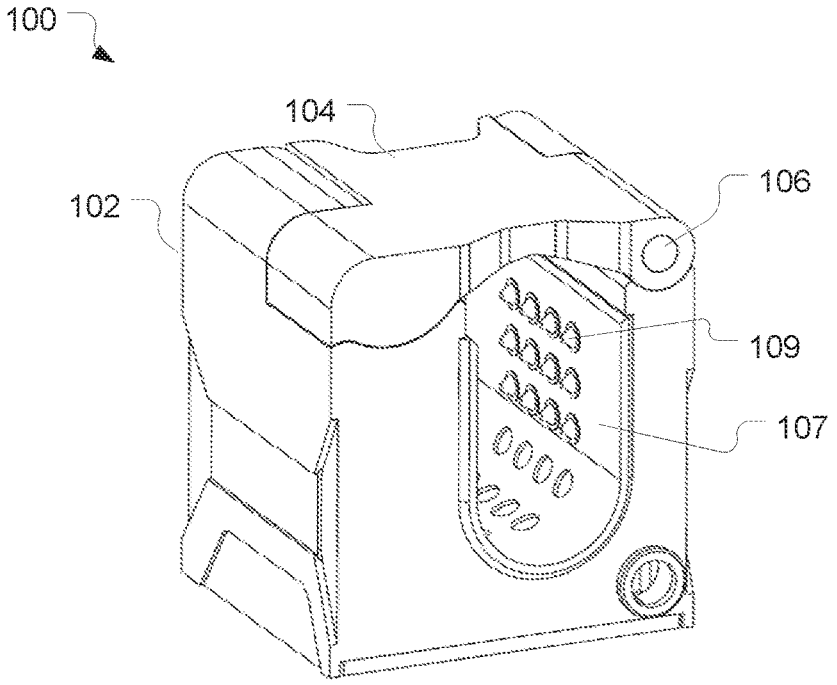
FIG. 6 depicts an embodiment of a weapon security apparatus in a closed state.

Referring to FIG. 6, an embodiment of a weapon security apparatus 100 is depicted in a closed state. The weapon security apparatus 100 may include a base member 102, a gate member 104, and a hinge 106. The apparatus 100 may further include a grip pad component 107 positioned along a surface of the base member 102. The grip pad component 107 may include a synthetic thermal rubber that absorbs vibration and shock to prevent damage to a weapon. The grip pad component 107 may include multiple grip nodes 109. The grip nodes 109 may flex and compress as a weapon is inserted into the grip pad component 107. In a compressed state, the grip nodes 109 may apply constant pressure on the weapon to secure and protect it. An advantage of the grip pad component 107 is that a weapon may be protected in addition to being retained, in contrast to typical weapon retention apparatuses that only retain a weapon without additional protection. Other advantages may exist.

Figure 7:
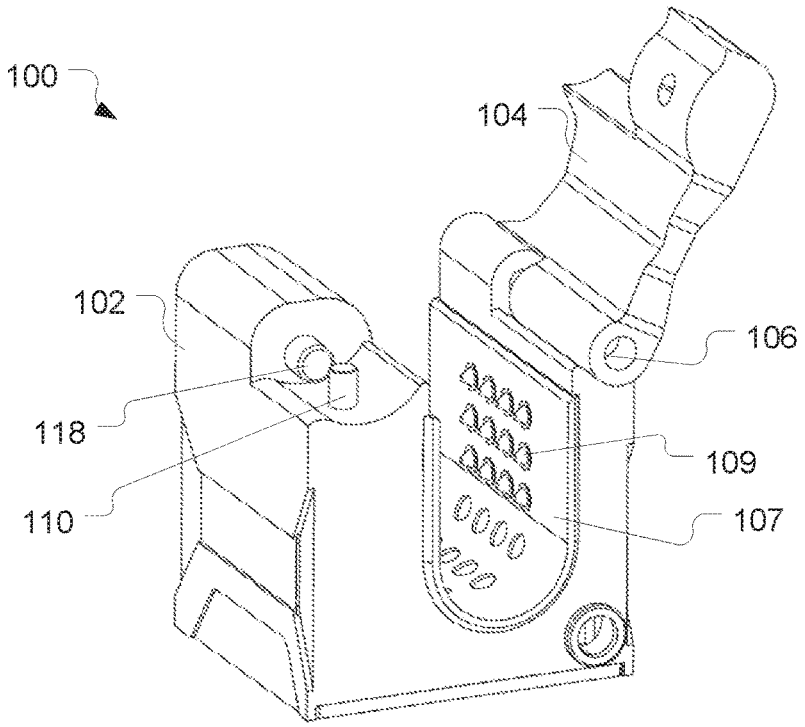
FIG. 7 depicts an embodiment of a weapon security apparatus in an open state.

Referring to FIG. 7, an embodiment of a weapon security apparatus is depicted in an open state. The apparatus may include the base member 102, the gate member 104, the hinge 106, the grip pad component 107, and the grip nodes 109. The apparatus may further include the retractable latch 110 and the locking pin 118.

Figure 8:
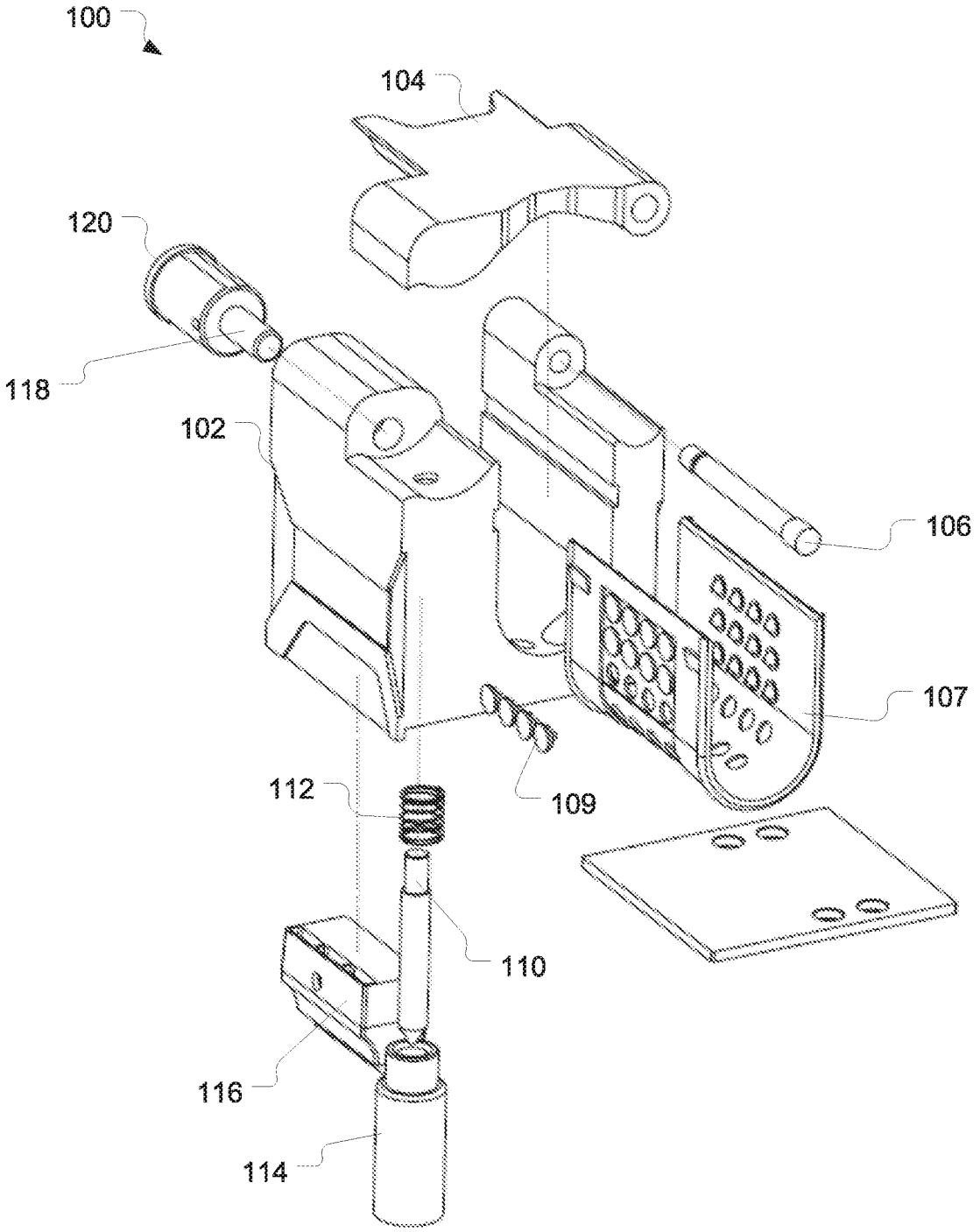
FIG. 8 is an exploded view depicting an embodiment of a weapon security apparatus.

Referring to FIG. 8, an exploded view of an embodiment of a weapon security apparatus 100 is depicted. The apparatus may include the base member 102, the gate member 104, the hinge 106, the grip pad component 107, the grip nodes 109, the retractable latch 110, a biasing component 112, a solenoid 114, a controller 116, a locking pin 118, and a key lock 120.

Although various embodiments have been shown and described, the present disclosure is not so limited and will be understood to include all such modifications and variations as would be apparent to one skilled in the art.

What is claimed is:

1. A weapon security apparatus comprising:

a base member;

a gate member pivotably coupled to the base member, the gate member moveable between an open position and a closed position relative to the base member, the base member and the gate member configured to enclose a portion of a weapon when the gate member is in the closed position, wherein the gate member has a proximal end and a distal end, and wherein the proximal end is pivotably attached to the base member;

a retracted latch configured to extend in a first direction to a non-retracted position, thereby engaging the gate member at a first point at the distal end and locking the gate member in the closed position, wherein the retractable latch is further configured to retract to a retracted position, thereby releasing the gate member;

a locking pin configured to extend in a second direction, perpendicular to the first direction, thereby engaging the gate member at a second point, perpendicular to the first point, at the distal end and locking the gate member in the closed position, wherein the locking pin is further configured to retract, thereby releasing the gate member;

a solenoid configured to retract the retractable latch when activated; and a controller configured to activate the solenoid with a first electrical current for a first period of time during which the retractable latch moves to the retracted position and with a second electrical current for a second period of time during which the retractable latch is held in the retracted position.

2. The apparatus of claim 1, wherein a surface at the distal end has hag a bore configured to receive the retractable latch therein when the retractable latch is in the non-retracted position.

3. The apparatus of claim 1, further comprising a key lock to enable a user to extend and retract the locking pin.

4. The apparatus of claim 1, wherein the first electrical current is greater than the second electrical current.

5. The apparatus of claim 1, wherein the second electrical current is great enough to hold the retractable latch in the retracted position but not great enough to retract the latch.

6. The apparatus of claim 1, further comprising a biasing member configured to move the retractable latch into the non-retracted position when the solenoid is not activated.

7. The apparatus of claim 6, wherein the biasing member is a spring.

8. The apparatus of claim 1, wherein the base member and the gate member are formed from a billet metal material.

9. The apparatus of claim 1, wherein the controller is integrated into the base member.

10. The apparatus of claim 1, further comprising a grip pad configured to protect the weapon while the weapon is enclosed by the gate member.

11. A weapon security apparatus comprising:

a base member;

a gate member pivotably coupled to the base member, the gate member moveable between an open position and a closed position relative to the base member, the base member and the gate member configured to enclose a portion of a weapon when the gate member is in the closed position, wherein the gate member has a proximal end and a distal end, and wherein the proximal end is pivotably attached to the base member;

a retractable latch configured to extend in a first direction into an un-retracted state, thereby engaging the gate member at a first point at the distal end and locking the gate member in the closed position, wherein the retractable latch is further configured to retract into a retracted state, thereby releasing the gate member; and a locking pin configured to extend in a second direction, perpendicular to the first direction, into a locked position thereby engaging the gate member at a second point, perpendicular to the first point, at the distal end and locking the gate member in the closed position, wherein the locking pin is further configured to retract into an unlocked position, thereby releasing the gate member.

12. The apparatus of claim 11, further comprising:

a solenoid configured to retract the retractable latch when activated; and a controller configured to activate the solenoid with a first electrical current for a first period of time during which the retractable latch moves to the retracted state and with a second electrical current for a second period of time during which the retractable latch is held in the retracted state.

13. The apparatus of claim 12, wherein the first electrical current is higher than the second electrical current.

14. The apparatus of claim 12, wherein the second electrical current is great enough to hold the retractable latch in the retracted state but not great enough to retract the retractable latch.

15. The apparatus of claim 12, further comprising a biasing member configured to move the retractable latch into the un-retracted state when the solenoid is not activated.

16. A method comprising:

providing a base member of for a weapon security apparatus;

providing a gate member pivotably coupled to the base member, the gate member moveable between an open position and a closed position relative to the base member, the base member and the gate member configured to enclose a portion of a weapon when the gate member is in the closed position, wherein the gate member has a proximal end and a distal end, and wherein the proximal end is pivotably attached to the base member;

extending a retractable latch in a first direction into an un-retracted position, thereby engaging the gate member at a first point at the distal end and locking the gate member in the closed position;

extending a locking pin in a second direction, perpendicular to the first direction, into a locked position thereby engaging the gate member at a second point, perpendicular to the first point, at the distal end and locking the gate member in the closed position;

providing a solenoid configured to retract the retractable latch when activated; and providing a controller configured to activate the solenoid with a first electrical current for a first period of time during which the retractable latch moves to a retracted position and with a second electrical current for a second period of time during which the retractable latch is held in the retracted position.

17. The method of claim 16, wherein the second electrical current is great enough to hold the retractable latch in the retracted position but not great enough to retract the retractable latch.

* * * * *